US005228790A

United States Patent [19]

Wineman

[11] Patent Number: 5,228,790

[45] Date of Patent: Jul. 20, 1993

[54] AUXILIARY DEVICE FOR TYPEWRITER RIGHT MARGIN CORRECTION

[76] Inventor: Neal B. Wineman, 97 Speedwell, P.O. Box 8112, Sisters, Oreg. 97759

[21] Appl. No.: 792,793

[22] Filed: Nov. 15, 1991

[51] Int. Cl.[5] ..... B41J 19/68

[52] U.S. Cl. ..... 400/315; 400/344

[58] Field of Search ..... 400/64, 313, 314.3, 400/314.5, 315, 342, 344, 351

[56] References Cited

U.S. PATENT DOCUMENTS

| | | | |
|---|---|---|---|
| 1,389,718 | 9/1921 | Waldheim | 400/315 |
| 3,023,876 | 3/1962 | Niccolls | 400/315 |
| 3,915,278 | 10/1975 | Spence et al. | 400/64 |
| 3,981,383 | 9/1976 | Bittner et al. | 400/64 |
| 4,556,332 | 12/1985 | Maekawa | 400/3 |
| 4,678,351 | 7/1987 | Curley | 400/64 |
| 4,880,321 | 11/1989 | Sasaki | 400/64 |

OTHER PUBLICATIONS

IBM Technical Disclosure Bulletin, vol. 11, No. 3, Aug. 1968, "Automatic Carriage Return", J. O. Schaeffer.

*Primary Examiner*—Edgar S. Burr
*Assistant Examiner*—Stephen R. Funk

[57] ABSTRACT

A mechanical device to be easily placed and removed over the margin rod of a key operated machine and having motion transfer levers which mechanically couple certain of its keys to other corresponding keys of the machine. The device is suitable for providing automatic carriage return after the space bar is activated within the margin zone, thus providing for improved alignment of the right margin, compression of the typed information, and increased typing speed.

1 Claim, 1 Drawing Sheet

AUXILIARY DEVICE FOR TYPEWRITER RIGHT MARGIN CORRECTION

FIELD OF INVENTION

This invention relates to improvements in key operated machines, more particularly an auxiliary device which improves the alignment of the last character on a typewritten line by automatically activating the return mechanism when the space key is depressed while the typing carriage is in the margin zone.

DESCRIPTION OF PRIOR ART

Typewriters with movable print carriages utilize left hand margin control devices. Since typewriters generally print from left to right, the left hand margin is easily maintained. However, the right hand margin is limited by the operators ability to complete words, space words, or hyphenate such words so as to justify the characters as evenly as possible along the right margin. This process is normally assisted by the use of a bell which indicates the presence of the carriage within the margin zone, often referred to as the hot zone. However, the resulting right margin usually takes on a very uneven appearance which is time consuming to correct.

To improve on this, typewriters may use a number of very complex techniques to adjust the right margin by automatically shifting to the next line upon recognition of a space, hyphen, period, comma, or other selected characters. Additionally, some machines have the capability to adjust word spacing such that all words end at the same point on the right margin. These techniques require circuit memory and storage and can not be adapted to existing mechanical machines.

It is desirable to utilize this particular device to eliminate the need under certain conditions for activating the return key, thus eliminating the early activation of the carriage return and reducing the chance for extending typing too far into the margin, both of which cause the right margin to be ragged in appearance. In addition to the restructuring of the right margin, the elimination of the need to activate the return key tends to increase overall typing speeds. Further, justification of the right margin, in addition to improved appearance and increased typing speed, usually allows for greater compression of the typed material on a given page.

In summary, this Right Hand Margin Correction Device and its relative simple design can accomplish multiple desired tasks with the associated mechanical linkages. Since the space key is normally activated after the use of a word, space, hyphen, period, comma, and related punctuation symbols within the prepared text, the space key in mechanical combination with the return key provides for its broad usage for achieving the stated objective of the device.

OBJECTIVES AND ADVANTAGES

It is an objective of the invention to provide an improved right hand margin for use with typewriters which utilize moveable carriage printers.

Another objective of this invention is to provide a device whereby within the margin zone or hot zone, that after the space key is activated, the carriage return is automatically activated.

Another objective of this invention is to provide a device whereby when typing within the margin zone, that after selecting punctuation involving the use of the hyphen, period, comma, or other selected characters and where there is further a normal requirement for a space before starting the next word, there exists a requirement for space key activation, which in turn causes this device to automatically initiate the carriage return.

Another objective of this invention is to allow the user to be free from the inconvenience of word and line arrangements and therefore be in a position to pay greater attention to the text being typed.

Another objective of this invention, by providing for automated carriage return after activation of the space key within the hot zone, is to remove the chance that the operator will not consistently activate the carriage return, thereby insuring that a more consistent and less ragged right margin results, thus further providing for an improved page appearance and possible compression of the typed information.

Another objective of this invention, by providing for automated carriage return after activation of the space key within the hot zone, is to allow the operator to concentrate on typing and provide a tool for increased typing speed.

Other objectives of this invention will become apparent as the following specification progresses, references being made to the accompanying drawing for an illustration of the invention.

REFERENCE NUMERALS IN DRAWINGS

| | |
|---|---|
| 10 Typewriter Right Margin Correction Device | |
| 12 Main structure | 14 Retention Slot |
| 16 Space key engagement lever | 18 Lever hook |
| 20 Return engagement plate | 30 Typewriter |
| 32 Space key | 33 Space lever |
| 34 Printer carriage | 36 Margin rod |
| 38 Return key | 40 Return lever |
| 42 Margin rod activator | 44 Margin lever extension |

DESCRIPTION AND OPERATION OF FIGURES

The Typewriter Right Margin Correction Device is broadly denoted by the numeral 10. Device 10 is to be mounted on a key operated typewriter so that the activation of certain keys will cause additional levers to be set into motion so as to accomplish the desired objectives.

Figure 3:
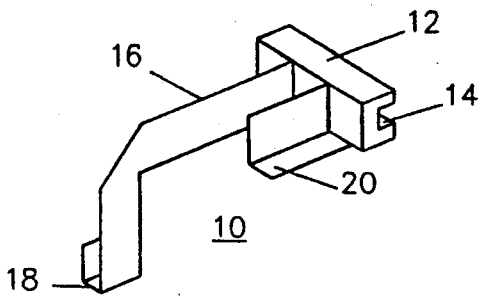
FIG. 3 is a isometric view of the Typewriter Right Margin Correction Device.

As shown in FIG. 3, the right margin device 10 consists of the main structure 12, which is magnetic in composition and further contains retention slot 14 for adhering same securely to the typewriter at margin rod 36. Also attached to the main structure 12 is space key engagement lever 16, which at its end possesses lever hook 18, which positions itself under the typewriter space lever 33. Also attached to main structure 12 is an additional lever, return engagement plate 20, which is designed to engage the top surface of the typewriter margin lever extension 44. The positioning of the device under the typewriter space lever and over the return lever 40 are further discussed.

Figure 1:
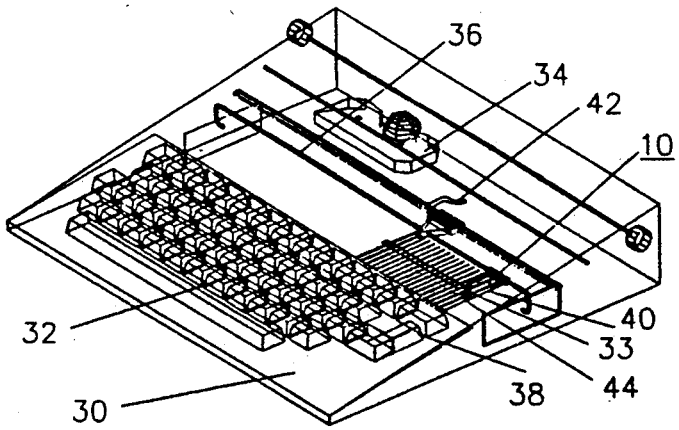
FIG. 1 is a perspective view of the Typewriter Right Margin Correction Device mounted on a standard typewriter.

In use, device 10 is lowered onto the typewriter as shown in FIG. 1 until retention slot 14 of the magnetic main structure 12 engages the typewriter margin rod 36. The magnetic properties of main structure 12 firmly holds device 10 in place on the typewriter 30. Device 10 merely rests on margin rod 36. Additionally, space key engagement lever 16 and lever hook 18 engages the underneath portion of the space lever 33. Return engagement plate 20 also protrudes from the main structure 12 and is positioned over typewriter return lever 40, and in an extended position over margin lever extension 44.

As typing proceeds in FIG. 1, when space key 32 is depressed, a corresponding depression of space key lever 33 occurs, pulling down lever hook 18 and attached space key engagement lever 16, thus tipping downward main structure 12 and attached return engagement plate 20. In this respective position, return engagement plate 20 does not reach margin lever extension 44, which is a part of the typewriter return lever 40 and no carriage return takes place.

However, as the printer carriage 34 extends itself towards the right margin, it activates margin rod activator 42, which in turn pushes forward margin rod 36. Accordingly, device 10 being attached thereto, also moves forward. In this forward position, the space key 32 utilization and corresponding depression of space lever 33 moves main structure 12 downward, thus also moving downward return engagement plate 20, which now extends over margin lever extension 44 of return lever 40, depressing same, and causing the printer carriage 34 to return. Thus, the return key 38 and associated return lever 40 are automatically activated any time that the space key is depressed when the typewriter is within the margin zone.

Figure 2:
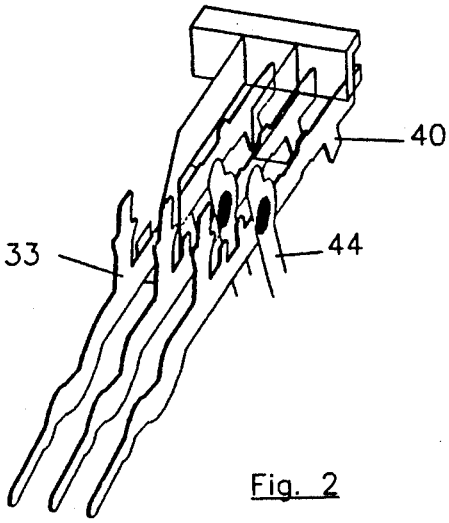
FIG. 2 is an exploded isometric view of the Typewriter Right Margin Correction Device which shows the interface of the device within the typewriter.

FIG. 2 shows an enlarged view of the interface between Device 10 and typewriter 30 and more specifically space key 33, return lever 40, and margin lever extension 44. In FIG. 2, lever hook 18 as shown in FIG. 3 can also be seen under space key 33, return engagement plate 20 as shown in FIG. 3 can also be seen over return lever 40 in FIG. 2, and margin lever extension 44 can be seen prior to the forward activation of Device 10. Device 10, when moved forward on margin rod 36, comes into a position over margin lever extension 44, thus the downward motion on space lever 33 tips main structure 12, lowering return engagement plate 20 over margin lever extension 44, causing the carriage return to be activated.

As shown in FIG. 1, device 10 is positioned above the key structure of the typewriter so that it cannot be accidentally activated in anyway. When it is desired to use the typewriter in the normal manner device 10 is merely lifted from the margin rod 36, lever hook 18 is released from beneath space lever 33, and the entire device is lifted away from the typewriter.

Although the description above contains many specifications, they should not be construed as limiting the scope of the invention, but merely providing illustrations of some of the presently preferred embodiments of the invention. For example, the support levers and key activation can be of various shapes, sizes, and configurations.

I claim:

1. A typewriter having a right margin zone, a margin rod, a carriage, a space key, a space lever, and a margin lever extension connected to a return lever, in combination with a mechanical linkage for providing an automatic carriage return, said mechanical linkage comprising:

a structural block having a space key engagement lever, a return engagement plate, and a retention slot within said structural block, said space key engagement lever engaging the space lever of the typewriter, said return engagement plate engaging the margin lever extension of the return lever, said retention slot engaging the margin rod of the typewriter to securely hold said structural block on the margin rod, wherein the carriage biases the margin rod when the carriage is within the right margin zone to align said return engagement plate with the margin lever extension of the return lever so that when the space key is activated, the space lever biases said space key engagement lever and thereby said return engagement plate to bias the margin lever extension of the return lever to activate an automatic carriage return.

* * * * *